US006959855B2

(12) United States Patent
Bridgeman et al.

(10) Patent No.: US 6,959,855 B2
(45) Date of Patent: Nov. 1, 2005

(54) CARBON-BASED WELD BLANKET, METHODS OF MAKING AND METHODS OF USE

(75) Inventors: William M. Bridgeman, Grand Rapids, MI (US); Eric D. Ritter, Monmouth, ME (US); Eliza L. Montgomery, Winthrop, ME (US)

(73) Assignee: Tex Tech Industries Inc., North Monmouth, ME (US)

( * ) Notice: Subject to any disclaimer, the term of this patent is extended or adjusted under 35 U.S.C. 154(b) by 0 days.

(21) Appl. No.: 10/739,169

(22) Filed: Dec. 19, 2003

(65) Prior Publication Data

US 2004/0128808 A1 Jul. 8, 2004

Related U.S. Application Data

(62) Division of application No. 09/910,962, filed on Jul. 23, 2001, now Pat. No. 6,696,374.
(60) Provisional application No. 60/220,562, filed on Jul. 25, 2000.

(51) Int. Cl.[7] ..... B23K 31/00
(52) U.S. Cl. ..... 228/214; 228/222
(58) Field of Search ..... 228/214, 222; 219/137.43; 428/362; 442/82

(56) References Cited

U.S. PATENT DOCUMENTS

| | | | | |
|---|---|---|---|---|
| 3,769,144 A | | 10/1973 | Economy et al. | |
| 3,900,625 A | * | 8/1975 | Chen | 428/110 |
| 4,196,118 A | * | 4/1980 | Fujie et al. | 524/142 |
| 4,522,673 A | | 6/1985 | Fell et al. | |
| 4,726,987 A | | 2/1988 | Trask et al. | |
| 4,780,359 A | | 10/1988 | Trask et al. | |
| 4,790,052 A | | 12/1988 | Olry | |
| 4,849,273 A | | 7/1989 | Skinner et al. | |
| 4,869,962 A | * | 9/1989 | McCullough, Jr. et al. | 428/408 |
| 4,950,533 A | | 8/1990 | McCullough, Jr. et al. | |
| 5,068,061 A | | 11/1991 | Knobel et al. | |
| 5,083,617 A | | 1/1992 | Pierce, Jr. | |
| 5,279,878 A | | 1/1994 | Fottinger et al. | |
| 5,490,567 A | | 2/1996 | Speer | |
| 5,534,325 A | | 7/1996 | Jorder et al. | |
| 5,582,912 A | | 12/1996 | McCullough, Jr. et al. | |
| 5,766,745 A | | 6/1998 | Smith et al. | |
| 5,792,216 A | * | 8/1998 | Kappel | 607/107 |

(Continued)

FOREIGN PATENT DOCUMENTS

JP 11-179550 7/1999

OTHER PUBLICATIONS

He Fu and Wang Maozhang, "Carbon Fiber and Its Composites", Scientific Press, Beijing (1995) (English translation of chapter 8.2).
American Kanox Corp., Letter package to Wilson Industries Inc., (1996), including Kanox product specification sheets and product brochure.
Wilson Sales Company purchas order,(1990), for Pyromex 300, and product specifications for Pyrom x.

*Primary Examiner*—Kiley S. Stoner
(74) *Attorney, Agent, or Firm*—Fitzpatrick, Cella, Harper & Scinto

(57) ABSTRACT

A non-woven weld blanket for protecting automobile exteriors and interiors and industrial equipment from weld spatter, comprising a needle punched webbing of pre-oxidized, polyacrylonitrile (PAN) fibers. The fabric is assembled using these carbon precursor fibers that have been interlocked by a needle punch process to produce a non-woven and non-plush blanket. The weld blanket is light-weight and is successful at a cost-effective thickness and density. In use, the blanket can be taped to automobile components or industrial equipment to ensure the security and protection of equipment from molten metal spatter near welding locations.

8 Claims, 1 Drawing Sheet

U.S. PATENT DOCUMENTS 5,888,652 A * 3/1999 Berbner et al. ..... 428/389
6,182,967 B1 2/2001 Green
6,237,203 B1 5/2001 Sheehan et al.
6,287,686 B1 * 9/2001 Huang et al. ..... 428/362
6,358,608 B1 * 3/2002 Hanyon et al. ..... 428/362
6,551,951 B1 * 4/2003 Fay et al. ..... 442/82
6,670,291 B1 * 12/2003 Tompkins et al. ..... 442/136
6,696,374 B2 * 2/2004 Bridgeman et al. ..... 442/402
6,800,367 B2 * 10/2004 Hanyon et al. ..... 428/364
2002/0031969 A1 * 3/2002 Bridgeman et al. ..... 442/402
2003/0006025 A1 * 1/2003 Manini et al. ..... 165/135
2003/0148693 A1 * 8/2003 Erb et al. ..... 442/391
2004/0091705 A1 * 5/2004 Hanyon et al. ..... 428/373
2004/0128808 A1 * 7/2004 Bridgeman et al. ..... 28/107

* cited by examiner

CARBON-BASED WELD BLANKET, METHODS OF MAKING AND METHODS OF USE

CROSS REFERENCE TO RELATED APPLICATIONS

This application is a divisional of, and claims the benefit of priority of, application Ser. No. 09/910,962, filed Jul. 23, 2001 now U.S. Pat. No. 6,696,374, which claims the benefit of priority under 35 U.S.C. § 119(e) to provisional application Ser. No. 60/220,562, filed Jul. 25, 2000, both of which are incorporated herein by reference.

BACKGROUND

1. Field of the Invention

The present invention relates to weld blankets that provide protection against weld spatter to auto body shop equipment, automobiles, and other industrial equipment. In particular, the present weld blanket is a non-woven, needle punched fabric comprising a plurality of precursor carbon fibers that have not been oxidized to a pure carbon fiber state, and which are tightly needle punched to an optimum density and weight to prohibit the burn-through of weld spatter.

2. Description of the Related Art

Ordinary welding blankets are either heavy and cumbersome or ineffective in stopping spatter burn-through. Technicians often choose not to use them because of this, resulting in damage from molten weld spatter on, for example, an automotive interior. A typical welding blanket may comprise unexpanded vermiculite and inorganic heat resistant fibrous material. See U.S. Pat. No. 4,849,273 to Skinner et al. Other known welding blankets have been made of various materials including vinyl, silica, glass fibers, Nomex® (aramid fiber)/Kevlar® (aramid fiber) fabric or "aramid fiber". All such blankets are relatively expensive and may still be subject to a weld spatter burn-through. These blankets are not considered reliable where weld spatter can cause damage to expensive car interior fabrics relative to seating and carpeting, headliners, and anywhere else where the threat of this burn-through exists due to close proximity welding.

Recently, carbon fibers have been used for their respective heat resistant end uses. Different categories of carbon fibers are based on modulus, tensile strength, raw material and final heat treatment temperature. Carbon fiber has been the basis for carbon fiber hard parts for use in exotic, lightweight, yet strong automotive and motorcycle components. These components, as a result of carbon fiber use, are very expensive. Some are rigid and brittle and used in other composites; others are soft and supple and used in apparel. In U.S. Pat. No. 5,582,912, the carbonaceous fibers are crimped to be non-linear.

Fibers that ultimately make up the carbon-based products, called precursor fibers are made by pyrolytic carbonization of a modified acrylic fiber. They are partially carbonized fibers, which transform into carbon or graphite when they undergo further carbonization in an inert atmosphere at high temperature. They are often blended 50-50 with para-aramid fibers creating a heavy woven fabric that does not normally lend itself to weld blanket applications.

In addition to mechanical improvements in yarn and fabric manufacture, there have been rapid advances in processes that improve textile characteristics for industrial applications. The many types of modern textile fabrics, produced from both traditional and man-made materials, are often classified according to structure. One process, known as needlefelting, mechanically moves fibers into the Z-direction to ensure strength. Needlefelts can vary in fiber location, strength, density, weight, thickness, and fiber type. Distinctive "carding" allows the fibers to be needle punched together into a given weight, while densification occurs via the needle punching process.

It would be preferred then that blankets used for industrial applications be lightweight, inexpensive, and manageable, while at the same time be capable of prohibiting the burn-through of weld spatter, and providing other advantages over the current state of the art Thus, there is a need for a weld blanket to have the lightweight and heat resistant properties exhibited by carbon fibers, but at the same time be inexpensive, capable of being unblended, and still have the tensile strength and density required for absorbing molten metal.

SUMMARY OF THE INVENTION

It is an objective of the present invention to provide a weld blanket, which is capable of prohibiting molten weld spatter burn-through, yet is lightweight, capable of being unblended, and inexpensive.

It is further an objective of the present invention to provide a weld blanket that is soft and non-abrasive and can be used within automotive interiors.

It is yet another objective of the present invention to provide a weld blanket that can be removably attached to automobile interiors or exteriors and/or industrial equipment using tape.

It is another objective of the present invention to provide a weld blanket that is not plush, thereby it can be hand vacuumed clean and freed from metal particle debris.

The above properties will assure that the user does not side-step the use of the weld blanket, thereby reducing in-shop accidents and unnecessary damages. Accordingly, what is provided is a weld blanket, comprising nonwoven precursor carbon fibers tightly needle punched to form the blanket at a maximum density and with minimum weight. The precursor carbon fibers have not been oxidized fully to a pure carbon fiber state. The weight of the blanket has been successful at a weight in the range of 12–16 ounces per square yard with a maximum density set by the needle punch process, which, along with the properties of the fibers, provides the greatest tensile strength of the fabric.

In a method for using the present invention, the weld blanket is taped or draped over the interior or exterior of a car or over industrial equipment for protection against weld spatter that results from welding on locations proximate to the valuable industrial and automobile components.

DETAILED DESCRIPTION OF THE PREFERRED EMBODIMENT

Figure 1:
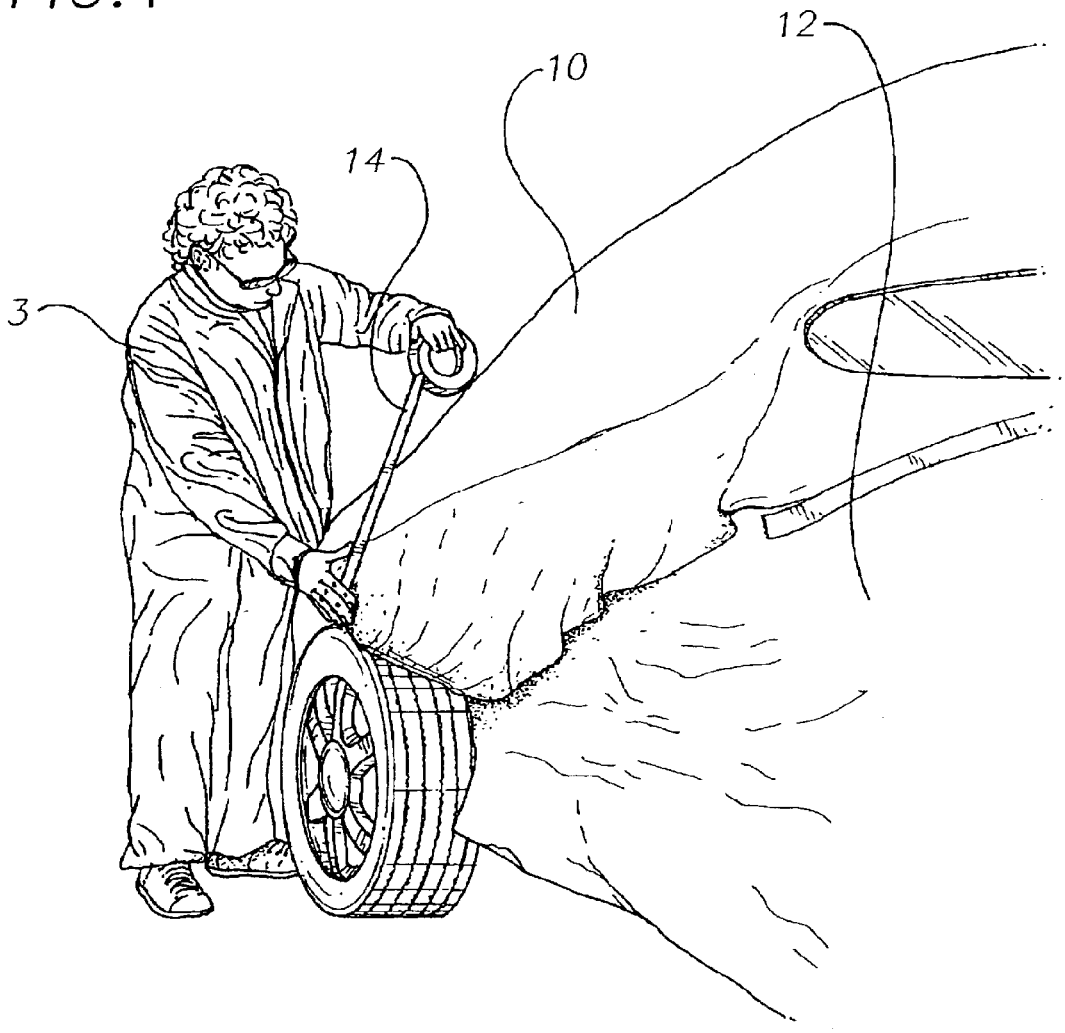
FIG. 1 shows the weld blanket in use being draped over an automobile. In this embodiment the blanket is held against the exterior of the automobile using an adhesive tape.

The invention will now be described in detail in relation to a preferred embodiment and implementation thereof which is exemplary in nature and descriptively specific as disclosed. As is customary, it will be understood that no limitation of the scope of the invention is thereby intended.

The invention encompasses such alterations and further modifications in the illustrated method, and such further applications of the principles of the invention illustrated herein, as would normally occur to persons skilled in the art to which the invention relates.

High-performance fibers are driven by special technical functions that require specific physical properties unique to these fibers. They usually have very high levels of at least one of the following properties: tensile strength, operating temperature, limiting oxygen index and chemical resistance.

One might define these fibers under consideration as those with very high-performance characteristics. Each of these fibers has a unique combination of properties which allows it to fill a niche in the upper end of the high-performance fiber spectrum. High-performance fabrics are typically technically driven, specialty oriented and made with smaller batch-type production.

Carbon precursor fibers are flame-retardant fibers and are made by pyrolytic carbonization of a modified acrylic fiber. They are partially carbonized fibers, which transform into carbon or graphite fiber when they undergo further carbonization in an inert atmosphere at high temperature. Carbon precursor fiber combines a high operating temperature with excellent flame resistance.

Polymerization of acrylonitrile produces PAN (table 1), which is the most common carbon fiber feedstock. The basic unit of PAN is:

Polyacrylonitrile

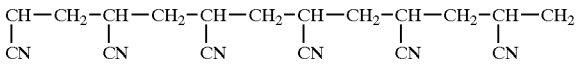

Oxidation involves heating the fibers to around 300° C. in air, which evolves hydrogen from the fibers and adds less volatile oxygen:

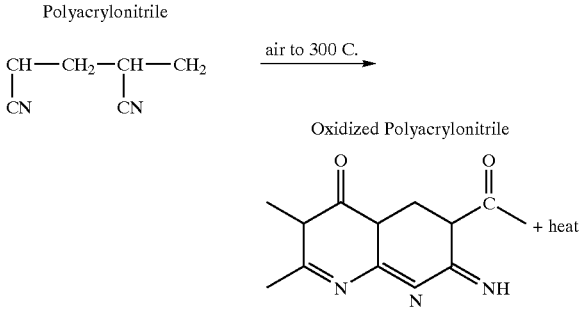

The polymer changes from a ladder to a stable ring structure, and the fiber changes color from white to black.

Table 1 shows a partial listing of brand names for the fibers.

TABLE 1

| | |
|---|---|
| PAN/Carbon (preoxidized poly-acrylonitrile fiber) | Fortafil ® carbon or graphite fibers<br>Hexcel ® carbon fibers<br>Lastan ® carbon fibers<br>Panox ® oxidized polyacrylonitrile fibers<br>Panotex ® flame resistant fabric<br>Tenax ® carbon fibers<br>Torayca ® carbon fiber yarn<br>Thornel ® carbon or graphite fibers |

In the preferred embodiment of the present invention, the pre-cursor fiber used to produce the present weld blanket is sold under the brand name Panox® (oxidized polyacrylonitrile fibers), indicated above, due to its heat resistant properties. However, where additional needs are present, other properties must be evaluated.

As a result, in selecting a pre-cursor fiber such as Panox® (oxidized polyacrylonitrile fibers) as the appropriate fiber according to the present invention, additional characteristics have been taken into consideration beyond the fiber's performance as a fire-resistant fiber. It is essential that the present invention be in the form of a lightweight blanket, being capable of comprising only pre-cursor fibers. The present invention may be blended with any type of other material such as Kevlar® aramid fiber to change the overall properties of the blanket, but, one of the primary characteristics of the present blanket is its overall ability to maintain its shape and be strong enough to consistently perform as a weld blanket while being capable of retaining the property of being unblended.

Accordingly, for the process of making such a weld blanket, a plurality of pre-oxidized polyacrylonitrile fibers, preferably sold under the brand name Panox, are needle punched, thereby each fiber is mechanically moved into the X, Y, and Z-direction and intermingled. The Z-directional strength and controlled fiber orientation improves shear strength and reduces the potential of ply delamination, or fiber separation. The resulting interlocking of the Panox fibers keeps the weld blanket more stable as compared to the more common methods of fabric manufacture, including weaving and lacemaking or netting. The weld blanket as formed is not plush, thereby allowing for an efficient method of freeing debris and metal particles clinging thereon after use simply by hand vacuuming the weld blanket.

Looms are generally known to those of ordinary skill to contain boards that have the needles implemented thereon and utilized, as determined by the mill, at varying frequencies, gap pattern, and having a certain length and barb length, etc. These variables can be altered and can also depend on the speed of mill machines and the speed at which the fabric is entered into the machines.

Utilizing a prototype device, low cost, low volume sample swatches of the weld blanket comprising these Panox fibers are needlefelted to produce a blanket of non-woven, pre-oxidized polyacrylonitrile at an adequate weight of 14 ounces per square yard±about 5%. But, generally the pre-oxidized polyacrylonitrile fibers may be intermingled to a weight in the range of 12–16 ounces per square yard.

The width of the blanket is successful at a thickness of approximately ¼ inches, but generally, the pre-oxidized poly-acrylonitrile fibers can also be intermingled to a thickness of at least 0.100 inches to correspond to any of the above successful weight features. Increasing the thickness of the blanket will obviously increase the heat resistant properties and weight of the blanket for heat shielding purposes, but the performance and service life of the weld blanket is determined by this combination of fabric weight and optimum density. The weight per unit area has been minimized since the fabric is, in combination, capable of being unblended, non-woven, and assembled by needlefelt, and the thickness produced is very cost effective. The use of a prototyping device enables multiple trial and error runs without excess cost and undue burden at the mill by reducing sample size of the fabric produced.

EXAMPLE

Staple length fibers, generally know as pre-oxidized PAN fibers, are made into batts by use of a textile card. Textile cards convert staple fibers into webbing, primarily held together via light entanglement and fiber to fiber cohesion. The fibers in the webbing are primarily orientated in a single direction; orientation and density are increased via cross-lapping. The crosslapped webbing is generally referred to, in the industry, as batting.

The invention makes use of the needle punching technology to mechanically lock the staple fibers together, thus forming a stable, polyacrylonitrile fabric structure. Needle punching technology makes use of a set of barbed needles, which is mechanically moved up and down through a batt of carded staple fiber. As the needle moves through the batt, the barbs, located along the needle's length, capture individual staple fibers. Through mechanical needling action the fibers are intermingled with each other and simultaneously compacted. This process results in a uniform, compacted fabric, in which the fibers are packed against one another to minimize fiber pull out. As a result of this mechanical action, fibers are orientated in the X, Y, and Z-direction of the fabric. These Z-directional fibers allow the needle punching technology to lock several (more than one) batts together to form fabric structures that are not possible with single carded batting.

In use and referring now to FIG. 1, an individual 3 places the weld blanket 10 over an exterior of an automobile 12. The weld blanket 10 may also be placed over or within an interior of an automobile or over any type of automobile glass, as well as over any type of industrial equipment or even directly on personnel who may require protection from weld spatter resulting from welding near these locations. When the weld blanket is exposed to the intense heat and/or molten metal weld spatter, the fibers will carbonize rather than burn.

As an alternative embodiment and as shown if FIG. 1, individual 3 uses tape 14 concurrently with weld blanket 10 and automobile 12 to removably secure weld blanket 10 to the automobile 12, or to any of the aforementioned articles to be protected.

We claim:

1. A method for protecting equipment from weld spatter comprising the steps of:

providing a weld blanket comprising a uniform compacted needlepunched fabric layer of partially oxidized polyacrylonitrile fibers not oxidized to a pure carbon state having a weight in the range of about 12 to about 16 ounces per square yard, and draping the weld blanket over the equipment while welding is conducted on or near the equipment, so that weld spatter contacting the blanket does not burn through to damage the equipment.

2. The method according to claim 1, further comprising the step of securing the weld blanket to the equipment with adhesive tape.

3. The method according to claim 1, wherein the weld blanket is non-plush, and further comprising the step of removing solidified weld spatter from the blanket with a vacuum.

4. The method according to claim 1, wherein the step of draping comprises draping the blanket over a part of an automobile.

5. The method according to claim 1, wherein the weld blanket consists essentially of a single uniform layer of compacted fabric obtained by needlepunching together multiple batts of fabric.

6. The method according to claim 1, wherein the preoxidized polyacrylonitrile fibers are blended with other material.

7. The method according to claim 6, wherein the preoxidized polyacrylonitrile fibers are blended with aramid fibers.

8. The method according to claim 5, wherein the multiple batts of fabric consist essentially of needlepunched preoxidized polyacrylonitrile fibers.

* * * * *